United States Patent [19]

Persson

[11] 4,326,093

[45] Apr. 20, 1982

[54] ELECTRODE CONTACT ASSEMBLY

[75] Inventor: John A. Persson, Gibsonia, Pa.

[73] Assignee: Lectromelt Corporation, Pittsburgh, Pa.

[21] Appl. No.: 172,531

[22] Filed: Jul. 28, 1980

[51] Int. Cl.[3] ..... H05B 7/107

[52] U.S. Cl. ..... 373/101

[58] Field of Search ..... 13/14–17

[56] References Cited

FOREIGN PATENT DOCUMENTS 2312099 3/1973 Fed. Rep. of Germany ..... 13/16

*Primary Examiner*—Roy N. Envall, Jr.

*Attorney, Agent, or Firm*—Fred Wiviott

[57] ABSTRACT

An electrode contact assembly includes spaced-apart U-shaped hollow tubular members each having a contact shoe affixed to each leg. A pressure ring surrounds the contact shoes for forcing the same into pressure engagement with the surface of an electrode. The tubular members are adapted for connection to sources of electrical energy and cooling fluid. A support ring concentric with the electrode and spaced above the pressure ring independently supports the pressure ring and the tubular members.

7 Claims, 4 Drawing Figures

ELECTRODE CONTACT ASSEMBLY

BACKGROUND OF THE INVENTION

This invention relates to electrode contact assemblies and, more particularly, contact assemblies for making electrical contact with self-baked electrodes.

Prior art contact assemblies with self-baked electrodes have generally included contact shoes which were cast or forged members having hollow passages for cooling water formed by drilling or by casting copper tubes into the contact shoe. One prior art contact assembly consisted of hollow tubing affixed to the surface of the contact jaw to provide both water cooling and electrical contact. Such prior art contact assemblies were generally expensive to fabricate and despite relatively large size, did not achieve more than a few points of electrical contact because the surfaces of self-based electrodes are relatively uneven.

OBJECT OF THE INVENTION

It is an object of the invention to provide new and improved contact elements for self-baked electrodes.

Another object of the invention is to provide contacts for self-baked electrodes which are relatively inexpensive and provide multiple points of electrical contact.

These and other objects and advantages of the present invention will become more apparent from the detailed description thereof taken with the accompanying drawings.

DESCRIPTION OF THE PREFERRED EMBODIMENT

Figure 1:
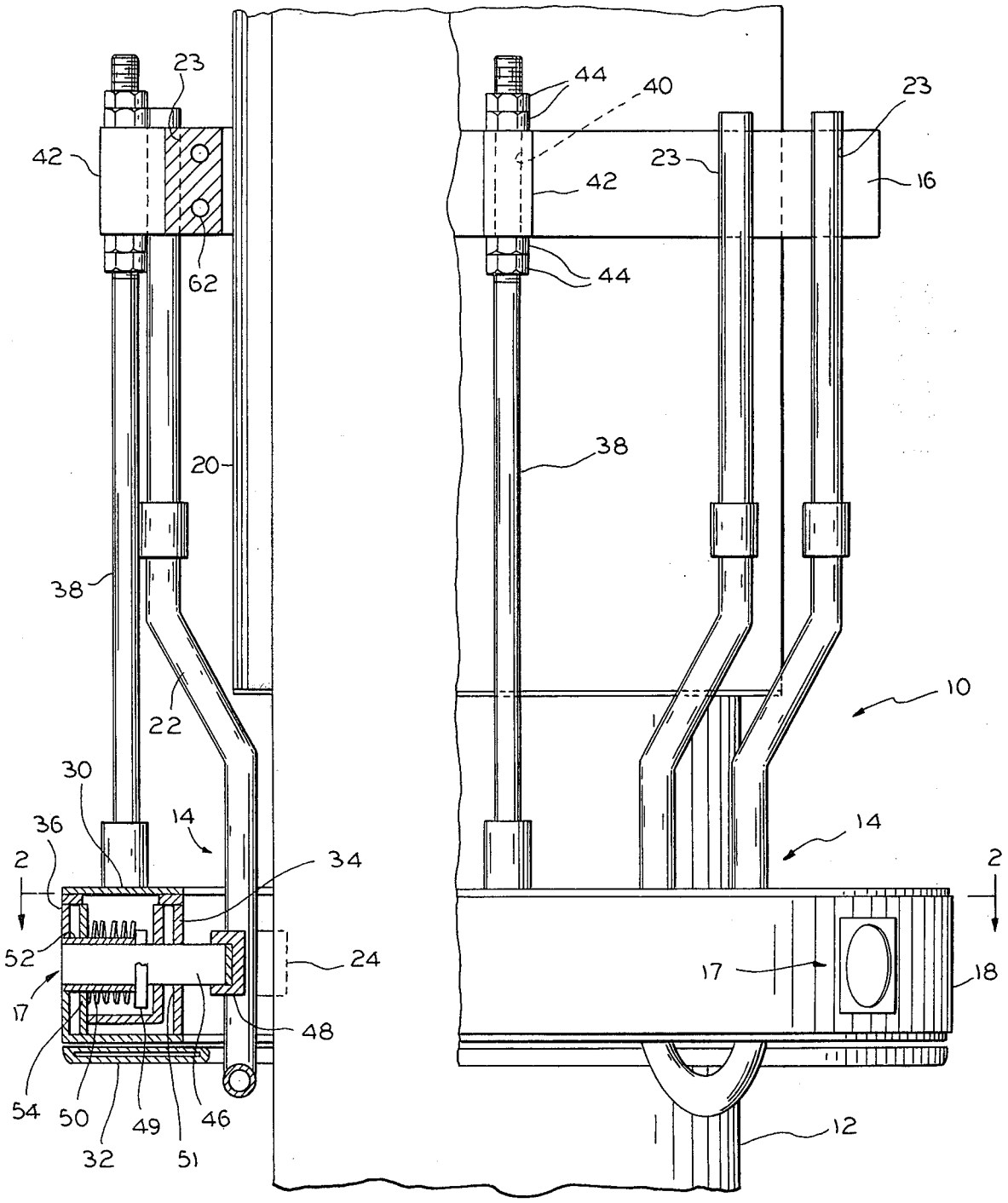
FIG. 1 is a side elevational view with parts broken away of a contact assembly according to the preferred embodiment of the present invention.

FIG. 1 shows an electrode clamp 10 according to the preferred embodiment of the invention to be applied to a self-baked electrode 12. The clamp 10 includes a plurality of contact elements 14 suspended from their upper ends in spaced-apart relation by a support ring 16 and at their lower ends are urged into high pressure contact with electrode 12 by pressure assemblies 17 which are mounted in a pressure ring 18.

As those skilled in the art will appreciate, self-baked electrodes, such as electrode 12, generally comprise an elongate, generally cylindrical carbon body which is formed in a vertically oriented tubular housing extending into the furnace. A paste-like material is inserted into the upper end of the tubular housing and is cured by the furnace heat as it is forced downwardly through the housing to permit the withdrawal of a solid electrode on the housing's lower end. In order to assist in the curing process, a shield 20 may be provided in surrounding relation to the furnace electrode 12 to permit heated air or inert gases to be passed downwardly along the surface of the electrode. This method of electrode formation results in an uneven electrode surface.

Each of the contact elements 22 includes an elongate, generally U-shaped tubular member 22 which may be bent outwardly intermediate its ends for passing around the shell 20. The support ring 16 is concentric with and spaced from the shell 20 and has pairs of spaced-apart, vertically oriented, semi-cylindrical grooves 23. The upper ends of members 22 are suitably affixed in grooves 23 such as by welding whereby tubular elements 22 are affixed in spaced-apart relation around the electrode 12 and in a generally vertical orientation. Mounted on each leg of each member 22 is a contact element 24 consisting of a short bar having a generally convex front face 26 and a rear face 28 which is complementary to the surface of member 22. Contact elements 24 are suitably affixed to members 22 by welding or silver brazing so as to insure good electrical interchange therebetween.

The pressure ring 18 is hollow and defined by upper and lower planer flanges 30 and 32 and inner and outer wrapper plates 34 and 36. The pressure ring 18 is supported in concentric spaced-apart relation below support ring 16 by a plurality of support rods 38. Each of the rods 38 is affixed at its lower end to the upper flange 30 of ring 18 and its upper end passes through a vertically oriented bore 40 formed in a lug 42 secured to the outer surface of ring 23. The upper end of each rod 38 is threaded for receiving a pair of nuts 44 above and below lug 42 so that the pressure ring 18 may be maintained in alignment with support ring 16.

Each pressure assembly 17 includes a pressure rod 46 having one end which engages a saddle member 48. A flange 49 intermediate the ends of rod 46 is engaged by washers 50 to urge saddle 48 into engagement with contact member 22. More specifically, the rod 46 extends through an opening 51 in the front wrapper 34 and is mounted for horizontal movement therethrough by means of a tubular member 52 supported in the rear wrapper 36. The springs 50 comprise spring washers having a center aperture for being received around sleeve 52 and are disposed between flange 50 and a fixed plate 54 also supported on the rear wrapper 36.

Figure 2:
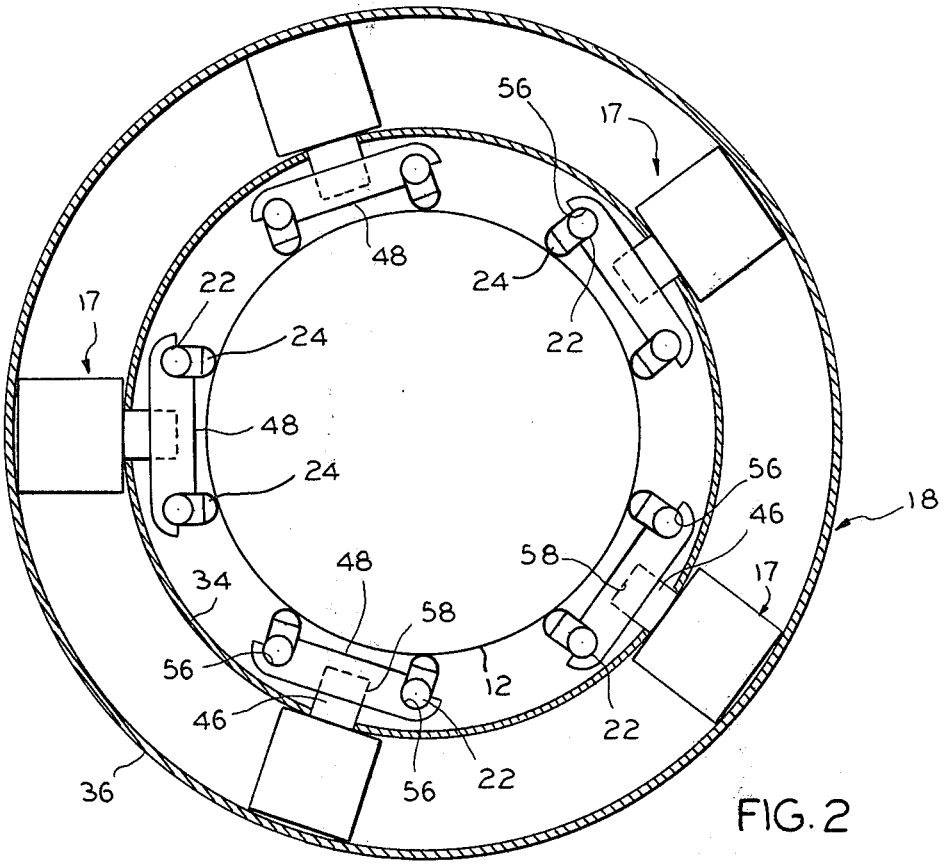
FIG. 2 is a view taken along lines 22 of FIG. 1.
Figure 3:
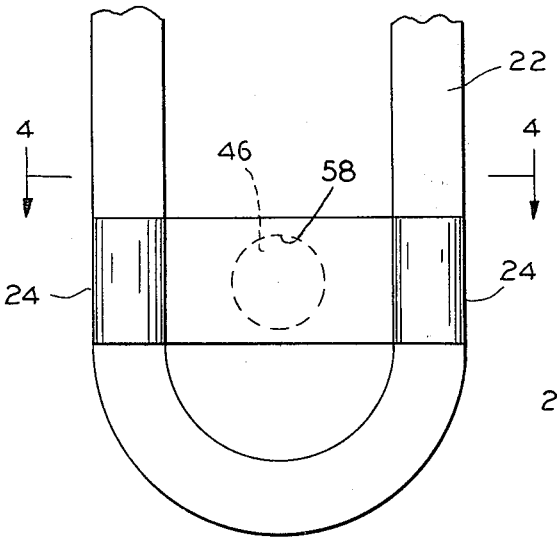
FIG. 3 is a fragmentary portion of the contact assembly of FIG. 1.
Figure 4:
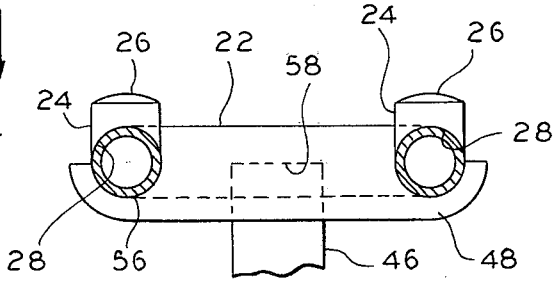
FIG. 4 is a view taken along lines 4—4 of FIG. 1.

As seen in FIG. 2, the saddles 48 comprise elongate members which respectively spans the gap between the legs of each contact member 22 and each has a pair of semi-cylindrical recesses 56 formed in its front face for engaging the legs of contact member 22. In addition, member 48 has a cylindrical recess 58 formed in its rear surface and extending generally radially for receiving the end of pressure rod 46.

The springs 50 acting on flange 49 of rod 46 urge the rod into engagement with the saddle 48 which in turn will force the contact shoes 26 into pressure engagement with the electrode 12 as the member 22 flexes. The convex front fact 26 of members 24 will provide line contact between each member 24 and electrode 12, even though the surface of the latter may be irregular.

Those skilled in the art will appreciate that the support ring 23 will itself be suitably supported from an electrode support and slipping assembly. As the lower end of the electrode becomes consumed or otherwise wears away, it will be periodically necessary to feed an additional electrode portion toward the furnace. This is accomplished by maintaining the assembly 10 in position and forcing the electrode 12 downwardly. The contour of the contact elements 24 permits such sliding movement. For a description of an electrode slipping assembly, reference is made to U.S. Pat. No. 4,154,974.

The upper ends of the contact members 22 are connected to a source of electrical energy (not shown) to provide the required electrode current and, in addition, the hollow interior of the elements 22 are connected to receive cooling liquids, such as water, to cool the contact shoes 24 as well as the members 22 and the saddle 48. The support ring 23 may also have cooling fluid passages 62 formed therein. While the members 22 are shown to be circular in cross-section any convenient cross-sectional configuration may be employed.

While only a single embodiment of the invention has been illustrated and described, it is not intended to be limited thereby but only by the scope of the appended claims.

I claim:

1. Contact assembly for arc furnace electrodes comprising support means having a pair of elongate spaced apart legs formed of an electrically conductive material, a separate contact shoe affixed to each of said legs and adjacent their lower ends, said contact shoes being substantially shorter than the legs to which they are affixed, each contact shoe having a front face for engaging an electrode and a rear face configured complementary to the respective leg to which it is attached, and a pressure member engaging the opposite side of each of said legs and adjacent their lower ends for jointly urging said contact shoes into engagement with an electrode whereby each of said contact shoes will individually engage the same to provide separate regions of electrical engagement between said contact assembly and said electrode, said legs being electrically conductive and having passages formed therein for conducting cooling fluid.

2. An electrode clamp including a plurality of spaced-apart contacts arranged for peripheral engagement with an electrode, each contact comprising support means having a pair of elongate legs and a contact member affixed to corresponding portions of each leg, each contact member being substantially shorter than the leg to which it is affixed, support means for engaging the upper ends of said legs for supporting the same in spaced-apart relation and for positioning said contact members in general alignment, and pressure means for engaging each pair of legs on the sides of said legs opposite said contact members and at the portions thereof to which said contact members are affixed for individually urging the same into engagement with an electrode to provide separate regions of electrical engagement between each said contact and said electrode.

3. The electrode clamp set forth in claim 2 wherein said pressure means includes a pressure member having a pair of spaced-apart engagement surfaces formed in one side and being complimentary to the surfaces of said legs and being in engagement with said legs on the side opposite said contacts, and means for engaging the other side of said pressure member for urging said contacts toward an electrode.

4. The electrode clamp set forth in claim 3 wherein each of said legs is electrically conductive and hollow for receiving a cooling fluid.

5. The electrode clamp set forth in claims 2, 3 or 4 and including a first ring means, said contact members being affixed at the upper ends of their respective legs to said first ring means, said contact members extending downwardly therefrom.

6. The electrode clamp set forth in claim 5 and including a second ring means disposed below said first ring means in surrounding relation to said contacts, said second ring means being supported by said first ring means independently of said contact, said pressure means including a plurality of pressure units mounted on said second ring means and one being associated with each contact member.

7. The electrode clamp set forth in claim 3 wherein said pressure member includes a recess in its other side, said pressure means including a plunger and spring means urging said plunger into said recess.

* * * * *